US006691531B1

(12) United States Patent
Martinez et al.

(10) Patent No.: US 6,691,531 B1
(45) **Date of Patent: *Feb. 17, 2004**

(54) DRIVER AND COMPRESSOR SYSTEM FOR NATURAL GAS LIQUEFACTION

(75) Inventors: Bobby D. Martinez, Missouri City, TX (US); Shrikant R. Thakkar, Sugar Land, TX (US); Paul R. Hahn, Houston, TX (US); Ned P. Baudat, Sugar Land, TX (US); Wesley R. Qualls, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/266,528

(22) Filed: Oct. 7, 2002

(51) Int. Cl.[7] ..... F25J 1/00
(52) U.S. Cl. ..... 62/612
(58) Field of Search ..... 62/611, 612, 613

(56) References Cited

U.S. PATENT DOCUMENTS 3,581,510 A * 6/1971 Hughes ..... 62/612
3,817,046 A 6/1974 Aoki et al.
3,964,891 A * 6/1976 Krieger ..... 62/612
4,566,885 A * 1/1986 Haak ..... 62/613
4,680,041 A * 7/1987 DeLong ..... 62/612
4,755,200 A * 7/1988 Liu et al. ..... 62/612
5,139,548 A 8/1992 Liu et al.
5,689,141 A 11/1997 Kikkawa et al.
6,070,429 A * 6/2000 Low et al. ..... 62/612
6,253,574 B1 * 7/2001 Stockmann et al. ..... 62/612
6,324,867 B1 * 12/2001 Fanning et al. ..... 62/613
6,389,844 B1 * 5/2002 Klein Nagel Voort ..... 62/612

OTHER PUBLICATIONS

Chiyoda Corp. "Availability of Refrigeration Process of Baseload LNG Plant." Presented at AIChE Spring Meeting in New Orleans, Louisiana, Mar. 2002.

* cited by examiner

*Primary Examiner*—William C. Doerrler
(74) *Attorney, Agent, or Firm*—Richmond, Hitchcock, Fish & Dollar

(57) ABSTRACT

Natural gas liquefaction system having an optimum configuration of mechanical drivers and compressors. A heat recovery system can be employed with the liquefaction system to enhance thermal efficiency. A unique start-up system can also be employed.

82 Claims, 1 Drawing Sheet

DRIVER AND COMPRESSOR SYSTEM FOR NATURAL GAS LIQUEFACTION

BACKGROUND OF THE INVENTION

1. Field of the Invention

Figure 1:
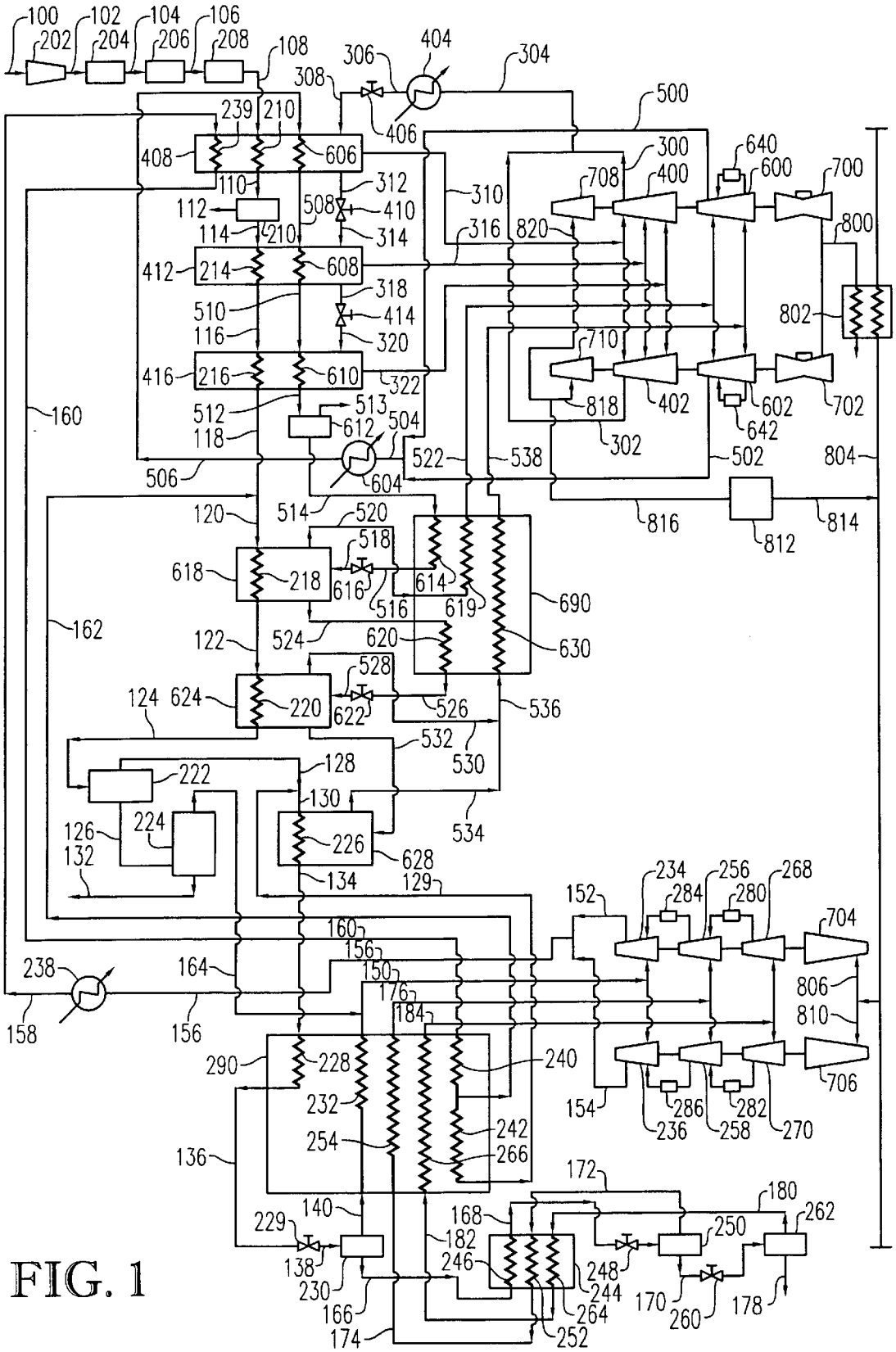

This invention concerns a method and an apparatus for liquefying natural gas. In another aspect, the invention concerns an improved driver and compressor configuration for a cascade-type natural gas liquefaction plant.

2. Description of the Prior Art

The cryogenic liquefaction of natural gas is routinely practiced as a means of converting natural gas into a more convenient form for transportation and storage. Such liquefaction reduces the volume by about 600-fold and results in a product which can be stored and transported at near atmospheric pressure.

With regard to ease of storage, natural gas is frequently transported by pipeline from the source of supply to a distant market. It is desirable to operate the pipeline under a substantially constant and high load factor but often the deliverability or capacity of the pipeline will exceed demand while at other times the demand may exceed the deliverability of the pipeline. In order to shave off the peaks where demand exceeds supply or the valleys when supply exceeds demand, it is desirable to store the excess gas in such a manner that it can be delivered when the supply exceeds demand. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source which is separated by great distances from the candidate market and a pipeline either is not available or is impractical. This is particularly true where transport must be made by ocean-going vessels. Ship transportation in the gaseous state is generally not practical because appreciable pressurization is required to significantly reduce the specific volume of the gas. Such pressurization requires the use of more expensive storage containers.

In order to store and transport natural gas in the liquid state, the natural gas is preferably cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by heat exchange with one or more refrigerants such as propane, propylene, ethane, ethylene, methane, nitrogen or combinations of the preceding refrigerants (e.g., mixed refrigerant systems). A liquefaction methodology which is particularly applicable to the current invention employs an open methane cycle for the final refrigeration cycle wherein a pressurized LNG-bearing stream is flashed and the flash vapors (i.e., the flash gas stream(s)) are subsequently employed as cooling agents, recompressed, cooled, combined with the processed natural gas feed stream and liquefied thereby producing the pressurized LNG-bearing stream.

There are five key economic drivers that must be considered when designing a natural gas liquefaction plant: 1) capital expense; 2) operating expense; 3) availability; 4) production efficiency; and 5) thermal efficiency. Capital expense and operating expense are common financial criteria used to analyze the economic feasability of a project. However, availability, production efficiency, and thermal efficiency are less generic terms that apply to projects utilizing complex equipment and thermal energy to produce a certain quantity of a product at a certain rate. In the area of natural gas liquefaction, "availability" is simply a measure of the amount of time that the plant is online (i.e., producing LNG), without regard to the quantity of LNG being produced while the plant is online. The "production efficiency" of an LNG plant is a measure of the time which the plant is online and producing at full design capacity. The "thermal efficiency" of an LNG plant is a measure of the amount of energy it takes to produce a certain quantity of LNG.

The configuration of compressors and mechanical drivers (e.g., gas turbines, steam turbines, electric motors, etc.) in a LNG plant greatly influences the capital expense, operating expense, availability, production efficiency, and thermal efficiency of the plant. Typically, as the number of compressors and drivers in an LNG plant is increased, the availability of the plant also increases due to the ability of the plant to remain online for a larger percentage of time. Such increased availability can be provided through a "two-trains-in-one" design in which compressors of a refrigeration cycle are connected to the refrigeration cycle in parallel so that if one compressor goes down, the refrigeration cycle can continue to operate at a reduced capacity. One disadvantage of the redundancy required in many "two-trains-in-one" designs is that the number of compressors and drivers must be increased, thereby increasing the capital expense of the project.

It is also known that the thermal efficiency of a natural gas liquefaction plant can be increased by recovering heat from certain heat-producing operations in the LNG plant and transferring the recovered heat to heat-consuming operations in the plant. However, the added equipment, piping, and construction expense required for heat recovery systems can greatly increase the capital expense of a LNG plant.

Thus, it is readily apparent that a balance between capital expense, operating expense, availability, production efficiency, and thermal efficiency exists for all LNG plant designs. A key to providing an economically competitive LNG plant is to offer a design that employs an optimum balance between capital expense, operating expense, availability, production efficiency, and thermal efficiency.

OBJECTS AND SUMMARY OF THE INVENTION

It is an object of the present invention to provide a novel natural gas liquefaction system having an optimum driver and compressor configuration that minimizes capital and operating expense while maximizing availability, production efficiency, and thermal efficiency.

It is another object of the invention to provide a novel natural gas liquefaction system having a waste heat recovery system that greatly enhances thermal efficiency without adding significantly to capital or operating expense.

It should be noted that the above objects are exemplary and need not all be accomplished by the claimed invention. Other objects and advantages of the invention will be apparent from the written description and drawings.

Accordingly, in one embodiment of the present invention, there is provided a process for liquefying natural gas comprising the steps of: (a) using a first gas turbine to drive a first compressor, thereby compressing a first refrigerant of a first refrigerant cycle; (b) using a second gas turbine to drive a second compressor, thereby compressing the first refrigerant of the first refrigerant cycle; (c) using a first steam turbine to drive a third compressor, thereby compressing a second refrigerant of a second refrigerant cycle; and (d) using a second steam turbine to drive a fourth compressor, thereby compressing the second refrigerant of the second refrigerant cycle.

In another embodiment of the present invention, there is provided a process for liquefying natural gas comprising the steps of: (a) using a first gas turbine to drive a first compressor and a second compressor, thereby compressing a first and a second refrigerant in the first and second compressors respectively; (b) using a second gas turbine to drive a third compressor and a fourth compressor, thereby compressing the first and second refrigerants in the third and fourth compressors respectively; (c) recovering waste heat from at least one of the first and second gas turbines; (d) using at least a portion of the recovered waste heat to help power a first steam turbine; and (e) compressing a third refrigerant in a fifth compressor driven by the first steam turbine.

In still another embodiment of the present invention, there is provided a process for liquefying natural gas comprising the steps of: (a) compressing a first refrigerant in a first compressor driven by a first gas turbine; (b) recovering waste heat from the first gas turbine; (c) using at least a portion of the waste heat recovered from the first gas turbine to help power a first steam turbine; and (d) compressing a second refrigerant in a second compressor driven by the first steam turbine, wherein the second refrigerant comprises in major portion methane.

In yet another embodiment of the present invention, there is provided a process for liquefying natural gas comprising the steps of: (a) compressing a first refrigerant in a first compressor driven by a first turbine, wherein the first refrigerant comprises in major portion a hydrocarbon selected from the group consisting of propane, propylene, and combinations thereof; (b) compressing a second refrigerant in a second compressor driven by the first turbine, wherein the second refrigerant comprises in major portion a hydrocarbon selected from the group consisting of ethane, ethylene, and combinations thereof; (c) using the first refrigerant in a first chiller to cool the natural gas; and (d) using the second refrigerant in a second chiller to cool the natural gas.

In yet still another embodiment of the present invention, there is provided a process for liquefying natural gas comprising the steps of: (a) using at least a portion of the natural gas as a first refrigerant to cool the natural gas; (b) compressing at least a portion of the first refrigerant with a first group of compressors driven by a first steam turbine; and (c) compressing at least a portion of the first refrigerant with a second group of compressors driven by a second steam turbine.

In a further embodiment of the present invention, there is provided an apparatus for liquefying natural gas that employs multiple refrigerants to cool the natural gas in multiple stages. The apparatus comprises first, second, third, fourth, and fifth compressors, first and second gas turbines, a first steam turbine, and a heat recovery system. The first and third compressors are operable to compress a first refrigerant, the second and fourth compressors are operable to compress a second refrigerant, and the fifth compressor is operable to compress a third refrigerant. The first gas turbine drives the first and second compressors, the second gas turbine drives the third and fourth compressors, and the first steam turbine drives the fifth compressor. The heat recovery system is operable to recover waste heat from at least one of the first and second gas turbines and employ the recovered waste heat to help power the first steam turbine.

In a still further embodiment of the present invention, there is provided an apparatus for liquefying natural gas that employs at least a portion of the natural gas as a first refrigerant. The apparatus comprises first and second steam turbines and first and second groups of compressors. The first group of compressors is driven by the first steam turbine and is operable to compress at least a portion of the first refrigerant. The second group of compressors is driven by the second steam turbine and is operable to compress at least a portion of the first refrigerant.

BRIEF DESCRIPTION OF THE DRAWING FIGURES

A preferred embodiment of the present invention is described in detail below with reference to the attached drawing figures, wherein:

FIG. 1 is a simplified flow diagram of a cascaded refrigeration process for LNG production which employs a novel driver/compressor configuration and heat recovery system. The numbering scheme in FIG. 1 can be summarized as follows:

100–199: Conduits for primarily methane streams

200–299: Equipment and vessels for primarily methane streams

300–399: Conduits for primarily propane streams

400–499: Equipment and vessels for primarily propane streams

500–599: Conduits for primarily ethylene streams

600–699: Equipment and vessels for primarily ethylene streams

700–799: Drivers and associated equipment

800–899: Conduits and equipment for heat recovery, stream generation, and miscellaneous components

DETAILED DESCRIPTION OF THE PREFERRED EMBODIMENT

As used herein, the term open-cycle cascaded refrigeration process refers to a cascaded refrigeration process comprising at least one closed refrigeration cycle and one open refrigeration cycle where the boiling point of the refrigerant/cooling agent employed in the open cycle is less than the boiling point of the refrigerating agent or agents employed in the closed cycle(s) and a portion of the cooling duty to condense the compressed open-cycle refrigerant/cooling agent is provided by one or more of the closed cycles. In the current invention, methane or a predominately methane stream is employed as the refrigerant/cooling agent in the open cycle. This stream is comprised of the processed natural gas feed stream and the compressed open methane cycle gas streams.

The design of a cascaded refrigeration process involves a balancing of thermodynamic efficiencies and capital costs. In heat transfer processes, thermodynamic irreversibilities are reduced as the temperature gradients between heating and cooling fluids become smaller, but obtaining such small temperature gradients generally requires significant increases in the amount of heat transfer area, major modifications to various process equipment and the proper selection of flowrates through such equipment so as to ensure that both flowrates and approach and outlet temperatures are compatible with the required heating/cooling duty.

One of the most efficient and effective means of liquefying natural gas is via an optimized cascade-type operation in combination with expansion-type cooling. Such a liquefaction process is comprised of the sequential cooling of a natural gas stream at an elevated pressure, for example about 625 psia, by sequentially cooling the gas stream by passage through a multistage propane cycle, a multistage ethane or ethylene cycle, and an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point. As used herein, the term "propane chiller" shall denote a cooling system that employs a refrigerant having a boiling point the same as, or similar to, that of propane or propylene. As used herein, the term "ethylene chiller" shall denote a cooling system that employs a refrigerant having a boiling point the same as, or similar to, that of ethane or ethylene. As used herein, the terms "upstream" and "downstream" shall be used to describe the relative positions of various components of a natural gas liquefaction plant along the flow path of natural gas through the plant.

Various pretreatment steps provide a means for removing undesirable components, such as acid gases, mercaptan, mercury, and moisture from the natural gas feed stream delivered to the facility. The composition of this gas stream may vary significantly. As used herein, a natural gas stream is any stream principally comprised of methane which originates in major portion from a natural gas feed stream, such feed stream for example containing at least 85 percent methane by volume, with the balance being ethane, higher hydrocarbons, nitrogen, carbon dioxide and a minor amounts of other contaminants such as mercury, hydrogen sulfide, and mercaptan. The pretreatment steps may be separate steps located either upstream of the cooling cycles or located downstream of one of the early stages of cooling in the initial cycle. The following is a non-inclusive listing of some of the available means which are readily available to one skilled in the art. Acid gases and to a lesser extent mercaptan are routinely removed via a sorption process employing an aqueous amine-bearing solution. This treatment step is generally performed upstream of the cooling stages in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves.

The pretreated natural gas feed stream is generally delivered to the liquefaction process at an elevated pressure or is compressed to an elevated pressure, that being a pressure greater than 500 psia, preferably about 500 psia to about 900 psia, still more preferably about 500 psia to about 675 psia, still yet more preferably about 600 psia to about 675 psia, and most preferably about 625 psia. The stream temperature is typically near ambient to slightly above ambient. A representative temperature range being 60° F. to 138° F.

As previously noted, the natural gas feed stream is cooled in a plurality of multistage (for example, three) cycles or steps by indirect heat exchange with a plurality of refrigerants, preferably three. The overall cooling efficiency for a given cycle improves as the number of stages increases but this increase in efficiency is accompanied by corresponding increases in net capital cost and process complexity. The feed gas is preferably passed through an effective number of refrigeration stages, nominally two, preferably two to four, and more preferably three stages, in the first closed refrigeration cycle utilizing a relatively high boiling refrigerant. Such refrigerant is preferably comprised in major portion of propane, propylene or mixtures thereof, more preferably the refrigerant comprises at least about 75 mole percent propane, even more preferably at least 90 mole percent propane, and most preferably the refrigerant consists essentially of propane. Thereafter, the processed feed gas flows through an effective number of stages, nominally two, preferably two to four, and more preferably two or three, in a second closed refrigeration cycle in heat exchange with a refrigerant having a lower boiling point. Such refrigerant is preferably comprised in major portion of ethane, ethylene or mixtures thereof, more preferably the refrigerant comprises at least about 75 mole percent ethylene, even more preferably at least 90 mole percent ethylene, and most preferably the refrigerant consists essentially of ethylene. Each cooling stage comprises a separate cooling zone. As previously noted, the processed natural gas feed stream is combined with one or more recycle streams (i.e., compressed open methane cycle gas streams) at various locations in the second cycle thereby producing a liquefaction stream. In the last stage of the second cooling cycle, the liquefaction stream is condensed (i.e., liquefied) in major portion, preferably in its entirety thereby producing a pressurized LNG-bearing stream. Generally, the process pressure at this location is only slightly lower than the pressure of the pretreated feed gas to the first stage of the first cycle.

Generally, the natural gas feed stream will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much as possible of the $C_2$ and higher molecular weight hydrocarbons from the gas to produce a gas stream predominating in methane and a liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separation means, preferably conventional gas/liquid separators, will be dependant on a number of operating parameters, such as the $C_2$+ composition of the natural gas feed stream, the desired BTU content of the LNG product, the value of the $C_2$+ components for other applications and other factors routinely considered by those skilled in the art of LNG plant and gas plant operation. The $C_2$+ hydrocarbon stream or streams may be demethanized via a single stage flash or a fractionation column. In the latter case, the resulting methane-rich stream can be directly returned at pressure to the liquefaction process. In the former case, this methane-rich stream can be repressurized and recycle or can be used as fuel gas. The $C_2$+ hydrocarbon stream or streams or the demethanized $C_2$+ hydrocarbon stream may be used as fuel or may be further processed such as by fractionation in one or more fractionation zones to produce individual streams rich in specific chemical constituents (ex., $C_2$, $C_3$, $C_4$ and $C_5$+).

The pressurized LNG-bearing stream is then further cooled in a third cycle or step referred to as the open methane cycle via contact in a main methane economizer with flash gases (i.e., flash gas streams) generated in this third cycle in a manner to be described later and via expansion of the pressurized LNG-bearing stream to near atmospheric pressure. The flash gasses used as a refrigerant in the third refrigeration cycle are preferably comprised in major portion of methane, more preferably the refrigerant comprises at least about 75 mole percent methane, still more preferably at least 90 mole percent methane, and most preferably the refrigerant consists essentially of methane. During expansion of the pressurized LNG-bearing stream to near atmospheric pressure, the pressurized LNG-bearing stream is cooled via at least one, preferably two to four, and more preferably three expansions where each expansion employs as a pressure reduction means either Joule-Thomson expansion valves or hydraulic expanders. The expansion is followed by a separation of the gas-liquid product with a separator. When a hydraulic expander is employed and properly operated, the greater efficiencies associated with the recovery of power, a greater reduction in stream temperature, and the production of less vapor during the flash step will frequently more than off-set the more expensive capital and operating costs associated with the expander. In one embodiment, additional cooling of the pressurized LNG-bearing stream prior to flashing is made possible by first flashing a portion of this stream via one or more hydraulic expanders and then via indirect heat exchange means employing said flash gas stream to cool the remaining portion of the pressurized LNG-bearing stream prior to flashing. The warmed flash gas stream is then recycled via return to an appropriate location, based on temperature and pressure considerations, in the open methane cycle and will be recompressed.

When the pressurized LNG-bearing stream, preferably a liquid stream, entering the third cycle is at a preferred pressure of about 550–650 psia, representative flash pressures for a three stage flash process are about 170–210, 45–75, and 10–40 psia. Flashing of the pressurized LNG-bearing stream, preferably a liquid stream, to near atmospheric pressure produces an LNG product possessing a temperature of about −240° F. to −260° F.

A cascaded process uses one or more refrigerants for transferring heat energy from the natural gas stream to the refrigerant and ultimately transferring said heat energy to the environment. In essence, the overall refrigeration system functions as a heat pump by removing heat energy from the natural gas stream as the stream is progressively cooled to lower and lower temperatures.

The liquefaction process may use one of several types of cooling which include but is not limited to (a) indirect heat exchange, (b) vaporization, and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a corein-kettle heat exchanger, and a brazed aluminum plate-fin heat exchanger. The physical state of the refrigerant and substance to be cooled can vary depending on the demands of the system and the type of heat exchanger chosen. Thus, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A platefin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion.

Finally, expansion or pressure reduction cooling refers to cooling which occurs when the pressure of a gas, liquid or a two-phase system is decreased by passing through a pressure reduction means. In one embodiment, this expansion means is a Joule-Thomson expansion valve. In another embodiment, the expansion means is either a hydraulic or gas expander. Because expanders recover work energy from the expansion process, lower process stream temperatures are possible upon expansion.

The flow schematic and apparatus set forth in FIG. 1 is a preferred embodiment of the inventive liquefaction process. Those skilled in the art will recognized that FIG. 1 is a schematic representation only and therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

To facilitate an understanding of FIG. 1, the following numbering nomenclature is employed. Items numbered 100–199 correspond to flow lines or conduits which contain primarily methane. Items numbered 200–299 are process vessels and equipment which contain and/or operate on a fluid stream comprising primarily methane. Items numbered 300–399 correspond to flow lines or conduits which contain primarily propane. Items numbered 400–499 are process vessels and equipment which contain and/or operate on a fluid stream comprising primarily propane. Items numbered 500–599 correspond to flow lines or conduits which contain primarily ethylene. Items numbered 600–699 are process vessels and equipment which contain and/or operate on a fluid stream comprising primarily ethylene. Items numbered 700–799 are mechanical drivers. Items numbered 800–899 are conduits or equipment which are associated with the heat recovery system, steam generation, or other miscellaneous components of the system illustrated in FIG. 1.

Referring to FIG. 1, a natural gas feed stream, as previously described, enters conduit 100 from a natural gas pipeline. In an inlet compressor 202, the natural gas is compressed and air cooled so that the natural gas exiting compressor 202 has a pressure generally in the range of from about 500 psia to about 800 psia and a temperature generally in the range of from about 75° F. to about 175° F. The natural gas then flows to an acid gas removal unit 204 via conduit 102. Acid gas removal unit 204 preferably employs an amine solvent (e.g., Diglycol Amine) to remove acid gasses such as $CO_2$ and $H_2S$. Preferably, acid gas removal unit 204 is operable to remove $CO_2$ down to less than 50 ppmv and $H_2S$ down to less than 2 ppmv. After acid gas removal, the natural gas is transferred, via a conduit 104, to a dehydration unit 206 that is operable to remove substantially all water from the natural gas. Dehydration unit 206 preferably employs a multi-bed regenerable molecular sieve system for drying the natural gas. The dried natural gas can then be passed to a mercury removal system 208 via conduit 106. Mercury removal system 208 preferably employs at least one fixed bed vessel containing a sulfur impregnated activated carbon to remove mercury from natural gas. The resulting pretreated natural gas is introduced to the liquefaction system through conduit 108.

As part of the first refrigeration cycle, gaseous propane is compressed in first and second multistage propane compressors 400, 402 driven by first and second gas turbine drivers 700, 702, respectively. The three stages of compression are preferably provided by a single unit (i.e., body) although separate units mechanically coupled together to be driven by a single driver may be employed. Upon compression, the compressed propane from first and second propane compressors 400, 402 are conducted via conduits 300, 302, respectively, to a common conduit 304. The compressed propane is then passed through common conduit 304 to a cooler 404. The pressure and temperature of the liquefied propane immediately downstream of cooler 404 are preferably about 100–130° F. and 170–210 psia. Although not illustrated in FIG. 1, it is preferable that a separation vessel be located downstream of cooler 404 and upstream of an expansion valve 406 for the removal of residual light components from the liquefied propane. Such vessels may be comprised of a single-stage gas liquid separator or maybe more sophisticated and comprised of an accumulator section, a condenser section and an absorber section, the latter two of which may be continuously operated or periodically brought on-line for removing residual light components from the propane. The stream from this vessel or the stream from cooler 404, as the case may be, is pass through a conduit 306 to a pressure reduction means such as expansion valve 406 wherein the pressure of the liquefied propane is reduced thereby evaporating or flashing a portion thereof. The resulting two-phase product then flows through conduit 308 into high-stage propane chiller 408 for indirect heat exchange with gaseous methane refrigerant introduced via conduit 158, natural gas feed introduced via conduit 108, and gaseous ethylene refrigerant introduced via conduit 506 via indirect heat exchange means 239, 210, and 606, thereby producing cooled gas streams respectively transported via conduits 160, 110 and 312.

The flashed propane gas from chiller 408 is returned to the high stage inlets of first and second propane compressors 400, 402 through conduit 310. The remaining liquid propane is passed through conduit 312, the pressure further reduced by passage through a pressure reduction means, illustrated as expansion valve 410, whereupon an additional portion of the liquefied propane is flashed. The resulting two-phase stream is then fed to an intermediate-stage propane chiller 412 through conduit 314, thereby providing a coolant for chiller 412.

The cooled natural gas feed stream from high-stage propane chiller 408 flows via conduit 110 to a knock-out vessel 210 wherein gas and liquid phases are separated. The liquid phase, which is rich in C3+ components, is removed via conduit 112. The gaseous phase is removed via conduit 114 and conveyed to intermediate-stage propane chiller 412. Ethylene refrigerant is introduced to chiller 412 via conduit 508. In chiller 412, the processed natural gas stream and an ethylene refrigerant stream are respectively cooled via indirect heat exchange means 214 and 608 thereby producing a cooled processed natural gas stream and an ethylene refrigerant stream via conduits 116 and 510. The thus evaporated portion of the propane refrigerant is separated and passed through conduit 316 to the intermediate-stage inlets of propane compressors 400, 402. Liquid propane is passed through conduit 318, the pressure further reduced by passage through a pressure reduction means, illustrated as expansion valve 414, whereupon an additional portion of liquefied propane is flashed. The resulting two-phase stream is then fed to a low-stage propane chiller/condenser 416 through conduit 320 thereby providing coolant to chiller 416.

As illustrated in FIG. 1, the cooled processed natural gas stream flows from intermediate-stage propane chiller 412 to low-stage propane chiller/condenser 416 via conduit 116. In chiller 416, the stream is cooled via indirect heat exchange means 216. In a like manner, the ethylene refrigerant stream flows from intermediate-stage propane chiller 412 to low-stage propane chiller/condenser 416 via conduit 510. In the latter, the ethylene-refrigerant is condensed via an indirect heat exchange means 610 in nearly its entirety. The vaporized propane is removed from low-stage propane chiller/condenser 416 and returned to the low-stage inlets of propane compressors 400, 402 via conduit 322. Although FIG. 1 illustrates cooling of streams provided by conduits 116 and 510 to occur in the same vessel, the chilling of stream 116 and the cooling and condensing of stream 510 may respectively take place in separate process vessels (ex., a separate chiller and a separate condenser, respectively).

As illustrated in FIG. 1, a portion of the cooled compressed open methane cycle gas stream is provided via conduit 162, combined with the processed natural gas feed stream exiting low-stage propane chiller/condenser 416 via conduit 118, thereby forming a liquefaction stream and this stream is then introduced to a high-stage ethylene chiller 618 via conduit 120. Ethylene refrigerant exits low-stage propane chiller/condenser 416 via conduit 512 and is fed to a separation vessel 612 wherein light components are removed via conduit 513 and condensed ethylene is removed via conduit 514. Separation vessel 612 is analogous to the earlier vessel discussed for the removal of light components from liquefied propane refrigerant and may be a single-stage gas/liquid separator or may be a multiple stage operation resulting in a greater selectivity of the light components removed from the system. The ethylene refrigerant at this location in the process is generally at a temperature in the range of from about −15° F. to about −30° F. and a pressure in the range of from about 270 psia to about 300 psia. The ethylene refrigerant, via conduit 514, then flows to a main ethylene economizer 690 wherein it is cooled via indirect heat exchange means 614 and removed via conduit 516 and passed to a pressure reduction means, such as an expansion valve 616, whereupon the refrigerant is flashed to a preselected temperature and pressure and fed to high-stage ethylene chiller 618 via conduit 518. Vapor is removed from this chiller via conduit 520 and routed to main ethylene economizer 690 wherein the vapor functions as a coolant via indirect heat exchange means 619. The ethylene vapor is then removed from ethylene economizer 690 via conduit 522 and fed to the high-stage inlets of first and second ethylene compressors 600, 602. The ethylene refrigerant which is not vaporized in high-stage ethylene chiller 618 is removed via conduit 524 and returned to ethylene economizer 690 for further cooling via indirect heat exchange means 620, removed from ethylene economizer 690 via conduit 526 and flashed in a pressure reduction means, illustrated as expansion valve 622, whereupon the resulting two-phase product is introduced into a low-stage ethylene chiller 624 via conduit 528. The liquefaction stream is removed from the high-stage ethylene chiller 618 via conduit 122 and directly fed to low-stage ethylene chiller 624 wherein it undergoes additional cooling and partial condensation via indirect heat exchange means 220. The resulting two-phase stream then flows via conduit 124 to a two phase separator 222 from which is produced a methane-rich vapor stream via conduit 128 and, via conduit 126, a liquid stream rich in $C_2$+ components which is subsequently flashed or fractionated in vessel a 224 thereby producing, via conduit 132, a heavies stream and a second methane-rich stream which is transferred via conduit 164 and, after combination with a second stream via conduit 150, is fed to high-stage methane compressors 234, 236.

The stream in conduit 128 and a cooled compressed open methane cycle gas stream provided via conduit 129 are combined and fed via conduit 130 to a low-stage ethylene condenser 628 wherein this stream exchanges heat via indirect heat exchange means 226 with the liquid effluent from low-stage ethylene chiller 624 which is routed to low-stage ethylene condenser 628 via conduit 532. In condenser 628, the combined streams are condensed and produced from condenser 628, via conduit 134, is apressurized LNG-bearing stream. The vapor from low-stage ethylene chiller 624, via conduit 530, and low-stage ethylene condenser 628, via conduit 534, are combined and routed via conduit 536 to main ethylene economizer 690 wherein the vapors function as a coolant via indirect heat exchange means 630. The stream is then routed via conduit 538 from main ethylene economizer 690 to the low-stage inlets of ethylene compressors 600, 602. As noted in FIG. 1, the compressor effluent from vapor introduced via the low-stage inlets of compressors 600, 602 is removed, cooled via inter-stage coolers 640, 642, and returned to ethylene compressors 600, 602 for injection with the high-stage stream present in conduit 522. Preferably, the two-stages are a single module although they may each be a separate module and the modules mechanically coupled to a common driver. The compressed ethylene product from ethylene compressors 600, 602 is routed to a common conduit 504 via conduits 500 and 502. The compressed ethylene is then conducted via common conduit 504 to a downstream cooler 604. The product from cooler 604 flows via conduit 506 and is introduced, as previously discussed, to high-stage propane chiller 408.

The pressurized LNG-bearing stream, preferably a liquid stream in its entirety, in conduit 134 is generally at a temperature in the range of from about −140° F. to about −110° F. and a pressure in the range of from about 600 psia to about 630 psia. This stream passes via conduit 134 through a main methane economizer 290 wherein the stream is further cooled by indirect heat exchange means 228 as hereinafter explained. From main methane economizer 290 the pressurized LNG-bearing stream passes through conduit 136 and its pressure is reduced by a pressure reductions means, illustrated as expansion valve 229, which evaporates or flashes a portion of the gas stream thereby generating a flash gas stream. The flashed stream is then passed via conduit 138 to a high-stage methane flash drum 230 where it is separated into a flash gas stream discharged through conduit 140 and a liquid phase stream (i.e., pressurized LNG-bearing stream) discharged through conduit 166. The flash gas stream is then transferred to main methane economizer 290 via conduit 140 wherein the stream functions as a coolant via indirect heat exchange means 232. The flash gas stream (i.e., warmed flash gas stream) exits main methane economizer 290 via conduit 150 where it is combined with a gas stream delivered by conduit 164. These streams are then fed to the inlets of high-stage methane compressors 234, 236. The liquid phase in conduit 166 is passed through a second methane economizer 244 wherein the liquid is further cooled via indirect heat exchange means 246 by a downstream flash gas stream. The cooled liquid exits second methane economizer 244 via conduit 168 and is expanded or flashed via a pressure reduction means, illustrated as expansion valve 248, to further reduce the pressure and at the same time, evaporate a second portion thereof. This flash gas stream is then passed to intermediate-stage methane flash drum 250 where the stream is separated into a flash gas stream passing through conduit 172 and a liquid phase stream passing through conduit 170. The flash gas stream flows through conduit 172 to second methane economizer 244 wherein the gas cools the liquid introduced to economizer 244 via conduit 166 via indirect heat exchanger means 252. Conduit 174 serves as a flow conduit between indirect heat exchange means 252 in second methane economizer 244 and indirect heat exchange means 254 in main methane economizer 290. The warmed flash gas stream leaves main methane economizer 290 via conduit 176 which is connected to the inlets of intermediate-stage methane compressors 256, 258. The liquid phase exiting intermediate stage flash drum 250 via conduit 170 is further reduced in pressure, preferably to about 25 psia, by passage through a pressure reduction means, illustrated as an expansion valve 260. Again, a third portion of the liquefied gas is evaporated or flashed. The fluids from the expansion valve 260 are passed to final or low stage flash drum 262. In flash drum 262, a vapor phase is separated as a flash gas stream and passed through conduit 180 to second methane economizer 244 wherein the flash gas stream functions as a coolant via indirect heat exchange means 264, exits second methane economizer 244 via conduit 182 which is connected to main methane economizer 290 wherein the flash gas stream functions as a coolant via indirect heat exchange means 266 and ultimately leaves main methane economizer 290 via conduit 184 which is connected to the inlets of low-stage methane compressors 268, 270. The liquefied natural gas product (i.e., the LNG stream) from flash drum 262 which is at approximately atmospheric pressure is passed through conduit 178 to the storage unit. The low pressure, low temperature LNG boil-off vapor stream from the storage unit is preferably recovered by combining such stream with the low pressure flash gases present in either conduits 180, 182, or 184; the selected conduit being based on a desire to match gas stream temperatures as closely as possible.

As shown in FIG. 1, methane compressors 234, 236, 256, 258, 268, 270 preferably exist as separate units that are mechanically coupled together to be driven by two drivers 704, 706. The compressed gas from the low-stage methane compressors 268, 270 passes through inter-stage coolers 280, 282 and is combined with the intermediate pressure gas in conduit 176 prior to the second-stage of compression. The compressed gas from intermediate-stage methane compressors 256, 258 is passed through inter-stage coolers 284, 286 and is combined with the high pressure gas provided via conduit 150 prior to the third-stage of compression. The compressed gas (i.e., compressed open methane cycle gas stream) is discharged from high-stage methane compressors 234, 236 through conduits 152, 154 and are combined in conduit 156. The compressed methane gas is then cooled in cooler 238 and is routed to high-stage propane chiller 408 via conduit 158 as previously discussed. The stream is cooled in chiller 408 via indirect heat exchange means 239 and flows to main methane economizer 290 via conduit 160. As used herein and previously noted, compressor also refers to each stage of compression and any equipment associated with interstage cooling.

As illustrated in FIG. 1, the compressed open methane cycle gas stream from chiller 408 which enters main methane economizer 290 undergoes cooling in its entirety via flow through indirect heat exchange means 240. A portion of this cooled stream is then removed via conduit 162 and combined with the processed natural gas feed stream upstream of high-stage ethylene chiller 618. The remaining portion of this cooled stream undergoes further cooling via indirect heat transfer means 242 in main methane economizer 290 and is produced therefrom via conduit 129. This stream is combined with the stream in conduit 128 at a location upstream of ethylene condenser 628 and this liquefaction stream then undergoes liquefaction in major portion in the ethylene condenser 628 via flow through indirect heat exchange means 226.

As illustrated in FIG. 1, it is preferred for first propane compressor 400 and first ethylene compressor 600 to be driven by a single first gas turbine 700, while second propane compressor 402 and second ethylene compressor 602 are driven by a single second gas turbine 702. First and second gas turbines 700, 702 can be any suitable commercially available gas turbine. Preferably, gas turbines 700, 702 are Frame 7 or Frame 9 gas turbines available from GE Power Systems, Atlanta, Ga. It can be seen from FIG. 1 that both the propane compressors 400, 402 and the ethylene compressors 600, 602 are fluidly connected to their respective propane and ethylene refrigeration cycles in parallel, so that each compressor provides full pressure increase for approximately one-half of the refrigerant flow employed in that respective refrigeration cycle. Such a parallel configuration of multiple propane and ethylene compressors provides a "two-trains-in-one" design that significantly enhances the availability of the LNG plant. Thus, for example, if it is required to shut down first gas turbine 700 for maintenance or repair, the entire LNG plant need not be shut down because second gas turbine 702, second propane compressor 402, and second ethylene compressor 602 can still be used to keep the plant online.

Such a "two-trains-in-one" philosophy is further indicated by the use of two drivers 704, 706 to power methane compressors 234, 236, 256, 258, 268, 270. A first steam turbine 704 is used to power first high-stage methane compressor 234, first intermediate-stage methane compressor 256, and first low-stage methane compressor 268, while a second steam turbine 706 is used to power second high-stage methane compressor 236, second intermediate-stage methane compressor 258, and second low-stage methane compressor 270. First and second steam turbines 704, 706 can be any suitable commercially available steam turbine. It can be seen from FIG. 1 that first methane compressors 234, 256, 268 are fluidly connected to the open methane refrigeration cycle in series with one another and in parallel with second methane compressors 236, 258, 270. Thus, first methane compressors 234,256, 268 cooperate to provide full pressure increase for approximately one-half of the methane refrigerant flow in the open methane refrigeration cycle, with each first compressor 268, 256, 234 providing an incremental portion of such full pressure increase. Similarly, second methane compressors 236, 258, 270 cooperate to provide full pressure increase for the other half of the methane refrigerant flow in the open methane refrigeration cycle, with each second compressor 270, 258, 236 providing an incremental portion of such full pressure increase. Such a configuration of methane drivers and compressors is consistent with the "two-trainsin-one" design philosophy. Thus, for example, if it is required to shut down first steam turbine 704 for maintenance or repair, the entire LNG plant need not be shut down because second steam turbine 706 and second methane compressors 236, 258, 270 can still be used to keep the plant online.

In addition to the "two-trains-in-one" advantages provided by the driver/compressor configuration for the open methane cycle, the use of two steam turbines 704,706 rather than a single driver allows gear boxes between the serially connected methane compressors 234, 256, 268 and 236, 258, 270 to be eliminated. Such gear boxes can be expensive to purchase, install, and maintain. The ability to run two steam turbines 704, 706 at higher speeds than a single large conventional turbine allows the gear box (typically located between the intermediate and high-stage compressors) to be eliminated. Further, the capital cost of two smaller steam turbines versus one large turbine is minimal, especially in light of the benefits provided with such a design.

The use of steam turbines 704, 706 rather than gas turbines in the open methane refrigeration cycle also allows for the thermal efficiency of the plant to be enhanced through waste heat recovery. FIG. 1 shows hot exhaust gasses exiting gas turbines 700, 702 and being conducted to an indirect heat exchanger 802 via conduit 800. In heat exchanger 802, heat from the gas turbine exhaust is transferred to a water/steam stream flowing in conduit 804. The heated steam in conduit 804 can then be conducted to first and second steam turbines 704, 706 via steam conduits 806, 810. Thus, the heat recovered from the exhaust of gas turbines 700, 702 can be used to help power steam turbines 704, 706, thereby enhancing the thermal efficiency of the LNG plant.

One challenge that exists for LNG plants using gas turbines to drive compressors is starting up the gas turbines. In order to start a gas turbine, the turbine must first be rotated by an external starter driver, such as an electric motor or a steam turbine. A steam turbine, however, can be started without the use of an external starter driver. FIG. 1 illustrates that a steam source, such as package boiler 812, can be used to start up steam turbines 704, 706 by conducting high pressure steam to steam turbines 704, 706 via conduits 814, 804, 806, 810. Further, helper/starter steam turbines 708, 710 can be mechanically coupled to gas turbines 700, 702. Such helper/starter steam turbines 708, 710 can be powered by package boiler 812 (via conduits 816, 818, 820) and used to rotate gas turbines 700, 702 up to a suitable starting RPM. Further, helper/starter turbines 708, 710 can also be employed during normal operation of the LNG plant to provide additional power for driving propane compressors 400, 402 and ethylene compressors 600, 602.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A process for liquefying natural gas, said process comprising the steps of:

(a) using a first gas turbine to drive a first compressor, thereby compressing a first refrigerant of a first refrigerant cycle;

(b) using a second gas turbine to drive a second compressor, thereby compressing the first refrigerant of the first refrigerant cycle;

(c) using a first steam turbine to drive a third compressor, thereby compressing a second refrigerant of a second refrigerant cycle; and (d) using a second steam turbine to drive a fourth compressor, thereby compressing the second refrigerant of the second refrigerant cycle.

2. A process according to claim 1; and (e) using the first gas turbine to drive a fifth compressor, thereby compressing a third refrigerant; and (f) using the second gas turbine to drive a sixth compressor, thereby compressing the third refrigerant.

3. A process according to claim 2, said second and third refrigerants having substantially different compositions.

4. A process according to claim 2, said first and third refrigerants having substantially different compositions.

5. A process according to claim 4, said first refrigerant comprising in major portion propane.

6. A process according to claim 5, said second refrigerant comprising in major portion methane, said third refrigerant comprising in major portion ethylene.

7. A process according to claim 1, said first refrigerant cycle being a closed refrigerant cycle.

8. A process according to claim 7, said second refrigerant cycle being an open refrigerant cycle.

9. A process according to claim 1, said first and second compressors being connected to the first refrigerant cycle in parallel, said second and third compressors being connected to the second refrigerant cycle in parallel.

10. A process according to claim 1; and (g) recovering waste heat from at least one of the first and second gas turbines; and (h) using at least a portion of the recovered waste heat to help power at least one of the first and second steam turbines.

11. A process according to claim 1; and (i) recovering waste heat from both the first and second gas turbines; and (j) using at least a portion of the recovered waste heat to help power the first and second steam turbines.

12. A process according to claim 1; and (k) using a third steam turbine to help drive the first compressor; and (l) using a fourth steam turbine to help drive the second compressor.

13. A process for liquefying natural gas, said process comprising the steps of:

(a) using a first gas turbine to drive a first compressor and a second compressor, thereby compressing a first and a second refrigerant in the first and second compressors respectively;

(b) using a second gas turbine to drive a third compressor and a fourth compressor, thereby compressing the first and second refrigerants in the third and fourth compressors respectively;

(c) recovering waste heat from at least one of the first and second gas turbines;

(d) using at least a portion of the recovered waste heat to help power a first steam turbine; and (e) compressing a third refrigerant in a fifth compressor driven by the first steam turbine.

14. A process according to claim 13, said first, second, and third refrigerants each comprising at least 50 mole percent of different first, second, and third hydrocarbons respectively.

15. A process according to claim 14, said first hydrocarbon being propane or propylene, said second hydrocarbon being ethane or ethylene, said third hydrocarbon being methane.

16. A process according to claim 15, said first, second, and third refrigerants each comprising at least 75 mole percent of the first, second, and third hydrocarbons respectively.

17. A process according to claim 13, said first and third compressors being connected to a first refrigeration cycle in parallel, said second and fourth compressors being connected to a second refrigeration cycle in parallel.

18. A process according to claim 13; and (f) using at least a portion of the recovered waste heat to help power a second steam turbine; and (g) compressing the third refrigerant in a sixth compressor driven by the second steam turbine.

19. A process according to claim 18, said first and third compressors being connected to a first refrigeration cycle in parallel, said second and fourth compressors being connected to a second refrigeration cycle in parallel, said fifth and sixth compressors being connected to a third refrigeration cycle in parallel.

20. A process according to claim 19; and (h) compressing the third refrigerant in seventh and eighth compressors driven by the first steam turbine; and (i) compressing the third refrigerant in ninth and tenth compressors driven by the second steam turbine.

21. A process according to claim 20, said fifth, seventh, and eighth compressors being connected to the third refrigeration cycle in series, said sixth, ninth, and tenth compressors being connected to the third refrigeration cycle in series.

22. A process according to claim 21, said fifth, seventh, and eighth compressors being connected to the third refrigeration cycle in parallel with the sixth, ninth, and tenth compressors.

23. A process according to claim 22, said first refrigerant comprising in major portion propane, said second refrigerant comprising in major portion ethylene, said third refrigerant comprising in major portion methane.

24. A process according to claim 13; and (j) combining at least a portion of the third refrigerant with the natural gas.

25. A process according to claim 13; and (k) using at least a portion of the natural gas as the third refrigerant in an open methane refrigerant cycle.

26. A process according to claim 13; and (l) cooling the third refrigerant with the first and second refrigerants.

27. A process according to claim 13, said process being a cascade-type natural gas liquefaction process.

28. A process for liquefying natural gas, said process comprising the steps of:

(a) compressing a first refrigerant in a first compressor driven by a first gas turbine;

(b) recovering waste heat from the first gas turbine;

(c) using at least a portion of the waste heat recovered from the first gas turbine to help power a first steam turbine;

(d) compressing a second refrigerant in a second compressor driven by the first steam turbine, said second refrigerant comprising in major portion methane;

(e) compressing a third refrigerant in a third compressor driven by a second gas turbine;

(f) recovering waste heat from the second gas turbine; and (g) using at least a portion of the waste heat recovered from second gas turbine to help power the first steam turbine.

29. A process according to claim 28, said first refrigerant comprising in major portion a hydrocarbon selected from the group consisting of propane, propylene, ethane, ethylene, and combinations thereof.

30. A process according to claim 28, said first refrigerant comprising in major portion propane or propylene, said second refrigerant comprising at least about 75 mole percent methane.

31. A process according to claim 28; and (h) cooling the natural gas with the first refrigerant in a first chiller; and (i) downstream of the first chiller, cooling the natural gas with the second refrigerant in an economizer.

32. A process for liquefying natural gas, said process comprising the steps of:

(a) compressing a first refrigerant in a first compressor driven by a first gas turbine;

(b) recovering waste heat from the first gas turbine;

(c) using at least a portion of the waste heat recovered from the first gas turbine to help power a first steam turbine;

(d) compressing a second refrigerant in a second compressor driven by the first steam turbine, said second refrigerant comprising in major portion methane;

(e) cooling the natural gas with the first refrigerant in a first chiller;

(f) downstream of the first chiller, cooling the natural gas with the second refrigerant in an economizer;

(g) compressing a third refrigerant in a third compressor driven by a second gas turbine;

(h) recovering waste heat from the second gas turbine; and (i) using at least a portion of the waste heat recovered from second gas turbine to help power the first steam turbine.

33. A process according to claim 32; and (j) downstream of the first chiller and upstream of the economizer, cooling the natural gas with the third refrigerant in a second chiller.

34. A process according to claim 33, said first refrigerant comprising in major portion propane or propylene, said second refrigerant comprising in major portion methane, said third refrigerant comprising in major portion ethane or ethylene.

35. A process according to claim 34; and (k) downstream of the second chiller, separating at least a portion of the natural gas for use as the second refrigerant.

36. A process according to claim 33; and (l) compressing at least a portion of the third refrigerant in a fourth compressor driven by the first gas turbine; and (m) compressing at least a portion of the first refrigerant in a fifth compressor driven by the second gas turbine.

37. A process for liquefying natural gas, said process comprising the steps of:

(a) compressing a first refrigerant in a first compressor driven by a first gas turbine;

(b) recovering waste heat from the first gas turbine;

(c) using at least a portion of the waste heat recovered from the first gas turbine to help power a first steam turbine;

(d) compressing a second refrigerant in a second compressor driven by the first steam turbine, said second refrigerant comprising in major portion methane;

(e) using at least a portion of the waste heat recovered from the first gas turbine to help power a second steam turbine; and (f) compressing at least a portion of the second refrigerant in a sixth compressor driven by the second steam turbine.

38. A process according to claim 37; and (g) compressing at least a portion of the second refrigerant in seventh and eighth compressors driven by the first steam turbine; and (h) compressing at least a portion of the second refrigerant in ninth and tenth compressors driven by the second steam turbine.

39. A process according to claim 38, said first refrigerant comprising in major portion propane, said second refrigerant comprising in major portion methane, said third refrigerant comprising in major portion ethylene.

40. A process for liquefying natural gas, said process comprising the steps of:

(a) compressing a first refrigerant in a first compressor driven by a first turbine, said first refrigerant comprising in major portion a hydrocarbon selected from the group consisting of propane, propylene, and combinations thereof;

(b) compressing a second refrigerant in a second compressor driven by the first turbine, said second refrigerant comprising in major portion a hydrocarbon selected from the group consisting of ethane, ethylene, and combinations thereof;

(c) using the first refrigerant in a first chiller to cool the natural gas;

(d) using the second refrigerant in a second chiller to cool the natural gas; and (e) using a portion of the natural gas as a third refrigerant in an economizer to cool the natural gas.

41. A process for liquefying natural gas, said process comprising the steps of:

(a) compressing a first refrigerant in a first compressor driven by a first turbine, said first refrigerant comprising in major portion a hydrocarbon selected from the group consisting of propane, propylene, and combinations thereof;

(b) compressing a second refrigerant in a second compressor driven by the first turbine, said second refrigerant comprising in major portion a hydrocarbon selected from the group consisting of ethane, ethylene, and combinations thereof;

(c) using the first refrigerant in a first chiller to cool the natural gas;

(d) using the second refrigerant in a second chiller to cool the natural gas;

(e) compressing at least a portion of the first refrigerant in a third compressor driven by a second turbine; and (f) compressing at least a portion of the second refrigerant in a fourth compressor driven by the second turbine.

42. A process according to claim 41, said first and second turbines being gas-powered turbines.

43. A process according to claim 42; and (g) using a portion of the natural gas as a third refrigerant in an economizer to cool the natural gas.

44. A process according to claim 43; and (h) compressing at least a portion of the third refrigerant in a fifth compressor driven by a third turbine, said third turbine being a steam-powered turbine.

45. A process according to claim 44; and (i) recovering waste heat from at least one of the first and second turbines; and (j) using at least a portion of the recovered waste heat to help power the third turbine.

46. A process according to claim 45, said second chiller being positioned downstream of the first chiller, said economizer being positioned downstream of the second chiller.

47. A process according to claim 46, said first refrigerant comprising in major portion propane, said second refrigerant comprising in major portion ethylene, said third refrigerant comprising in major portion methane.

48. A process according to claim 47; and (k) compressing at least a portion of the third refrigerant in a sixth compressor driven by a fourth turbine, said fourth turbine being a steam-powered turbine.

49. A process for liquefying natural gas, said process comprising the steps of:

(a) using a portion of the natural gas as a first refrigerant to cool the natural gas;

(b) compressing at least a portion of the first refrigerant with a first group of compressors driven by a first steam turbine; and (c) compressing at least a portion of the first refrigerant with a second group of compressors driven by a second steam turbine.

50. A process according to claim 49, said first and second groups of compressors being connected to a first refrigeration cycle in parallel.

51. A process according to claim 50, said first group of compressors comprising at least two individual compressors connected to the first refrigeration cycle in series, said second group of compressors comprising at least two individual compressors connected to the first refrigeration cycle in series.

52. A process according to claim 51, step (b) including rotating the individual compressors of the first group of compressors at substantially the same speed, step (c) including rotating the individual compressors of the second group of compressors at substantially the same speed.

53. A process according to claim 49, adjacent individual compressors of the first group of compressors being drivingly coupled to one another without the use of a gear box, adjacent individual compressors of the second group of compressors being drivingly coupled to one another without the use of a gear box.

54. A process according to claim 53, said first group of compressors comprising at least three individual compressors connected to a first refrigeration cycle in series, said second group of compressors comprising at least three individual compressors connected to the first refrigeration cycle in series.

55. A process according to claim 49; and (d) compressing a second refrigerant with a second refrigerant compressor driven by a first gas turbine;

(e) cooling the natural gas with the second refrigerant;

(f) recovering waste heat from the first gas turbine; and (g) using the recovered waste heat to help power at least one of the first and second steam turbines.

56. A process according to claim 55, said first refrigerant comprising in major portion methane, said second refrigerant comprising in major portion a hydrocarbon selected from the group consisting of propane, propylene, ethane, ethylene, and combinations thereof.

57. A method of starting up a LNG plant, said method comprising the steps of:

(a) generating high pressure steam in a steam generator;

(b) using a first portion of the high pressure steam to power a first starter steam turbine that is drivingly coupled to a first gas turbine;

(c) using a second portion of the high pressure steam to power a second starter steam turbine that is drivingly coupled to a second gas turbine;

(d) using a third portion of the high pressure steam to power a first main steam turbine that is drivingly coupled to a first group of compressors; and (e) using a fourth portion of the high pressure steam to power a second main steam turbine that is drivingly coupled to a first group of compressors.

58. An apparatus for liquefying natural gas, said apparatus employing multiple refrigerants in multiple refrigeration cycles for cooling the natural gas in multiple stages, said apparatus comprising:

a first compressor for compressing a first refrigerant of a first refrigeration cycle;

a second compressor for compressing a second refrigerant of a second refrigeration cycle;

a first gas turbine for driving the first and second compressors;

a third compressor for compressing the first refrigerant of the first refrigeration cycle;

a fourth compressor for compressing the second refrigerant of the second refrigeration cycle;

a second gas turbine for driving the third and fourth compressors;

a fifth compressor for compressing a third refrigerant of a third refrigeration cycle;

a first steam turbine for driving the fifth compressor; and a heat recovery system for recovering waste heat from at least one of the first and second gas turbines and employing the recovered waste heat to help power the first steam turbine.

59. An apparatus according to claim 58, said first gas turbine including an exhaust outlet, said first steam turbine including a steam inlet, said heat recovery system including an indirect heat exchanger having a first side fluidly coupled to the exhaust outlet of the first gas turbine and a second side fluidly coupled to the steam inlet of the first steam turbine.

60. An apparatus according to claim 58, said first and third compressors being fluidly connected to the first refrigeration cycle in parallel, said second and fourth compressors being fluidly connected to the second refrigeration cycle in parallel.

61. An apparatus according to claim 60; and a sixth compressor for compressing the third refrigerant of the third refrigeration cycle; and a second steam turbine for powering the sixth compressor.

62. An apparatus according to claim 61, said fifth and sixth compressors being fluidly connected to the third refrigeration cycle in parallel.

63. An apparatus according to claim 62; and a seventh compressor for compressing the third refrigerant, said seventh compressor being driven by the first steam turbine; and an eighth compressor for compressing the third refrigerant, said eighth compressor being driven by the second steam turbine.

64. An apparatus according to claim 63; and a ninth compressor for compressing the third refrigerant, said ninth compressor being driven by the first steam turbine; and a tenth compressor for compressing the third refrigerant, said tenth compressor being driven by the second steam turbine.

65. An apparatus according to claim 64, said fifth, seventh, and ninth compressors being fluidly connected to the third refrigeration cycle in series, said sixth, eighth, and tenth compressors being fluidly connected to the third refrigeration cycle in series.

66. An apparatus according to claim 65, said fifth, seventh, and ninth compressors being fluidly connected to the third refrigeration cycle in parallel with the sixth, eighth, and tenth compressors.

67. An apparatus for liquefying natural gas, said apparatus employing a first refrigerant in a first refrigeration cycle to help cool the natural gas, said apparatus comprising:

a first steam turbine;

a first group of compressors driven by the first steam turbine and operable to compress at least a portion of the first refrigerant;

a second steam turbine; and a second group of compressors driven by the second steam turbine and operable to compress at least a portion of the first refrigerant.

68. An apparatus according to claim 67, said first group of compressors comprising at least two individual compressors connected to the first refrigeration cycle in series, said second group of compressors comprising at least two individual compressors connected to the first refrigeration cycle in series.

69. An apparatus according to claim 68, said individual compressors of the first group of compressors being drivingly coupled to one another in a manner that requires all of the individual compressors of the first group of compressors to rotate at substantially the same speed when driven by the first steam turbine; and said individual compressors of the second group of compressors being drivingly coupled to one another in a manner that requires all of the individual compressors of the second group of compressors to rotate at substantially the same speed when driven by the second steam turbine.

70. An apparatus according to claim 67, said first and second groups of compressors being connected to the first refrigeration cycle in parallel.

71. An apparatus according to claim 70, said first refrigerant comprising in major portion methane.

72. An apparatus according to claim 68, said individual compressors of the first group of compressors being drivingly intercoupled without the use of a gear box, said individual compressors of the second group of compressors being drivingly intercoupled without the use of a gear box.

73. An apparatus according to claim 72, said first group of compressors comprising at least three individual compressors connected to the first refrigeration cycle in series, said second group of compressors comprising at least three individual compressors connected to the first refrigeration cycle in series.

74. An apparatus according to claim 73, said first refrigerant comprising at least 75 mole percent methane.

75. A process according to claim 1; and (m) vaporizing liquefied natural gas produced via steps (a)–(d).

76. A process according to claim 13; and (m) vaporizing liquefied natural gas produced via steps (a)–(e).

77. A process according to claim 28; and (r) vaporizing liquefied natural gas produced via steps (a)–(d).

78. A process according to claim 40; and (l) vaporizing liquefied natural gas produced via steps (a)–(d).

79. A process according to claim 49; and (h) vaporizing liquefied natural gas produced via steps (a)–(c).

80. A process according to claim 32; and (j) vaporizing liquefied natural gas produced via steps (a)–(i).

81. A process according to claim 37; and (g) vaporizing liquefied natural gas produced via steps (a)–(f).

82. A process according to claim 41; and (g) vaporizing liquefied natural gas produced via steps (a)–(f).

* * * * *